United States Patent [19]

Saito

[11] 4,374,558

[45] Feb. 22, 1983

[54] STEPS OF PASSENGER CONVEYOR

[75] Inventor: Cyuichi Saito, Katsuta, Japan

[73] Assignee: Hitachi, Ltd., Tokyo, Japan

[21] Appl. No.: 191,845

[22] Filed: Sep. 29, 1980

[30] Foreign Application Priority Data

Sep. 28, 1979 [JP] Japan ..... 54-123919

[51] Int. Cl.[3] ..... B66B 9/12

[52] U.S. Cl. ..... 198/333

[58] Field of Search ..... 198/333, 321, 326–327, 198/324–325; 52/31, 312, 177, 179, 182, 188, 183

[56] References Cited

U.S. PATENT DOCUMENTS 4,295,556 10/1981 Saito ..... 198/333

FOREIGN PATENT DOCUMENTS 2161442 7/1972 Fed. Rep. of Germany ..... 198/333

*Primary Examiner*—Andres Kashnikow
*Assistant Examiner*—Douglas D. Watts
*Attorney, Agent, or Firm*—Antonelli, Terry & Wands

[57] ABSTRACT

Steps of a passenger conveyor are designed to include a tread with a multiplicity of cleats and grooves disposed in alignment with teeth of comb plates at the entrance and exit areas. A riser is connected to one end of the tread and frames attached to other ends of the tread. The tread is formed of steel sheet and has cleats and grooves in the center and planar surface portions at the edges. Side pieces extending in the direction of movement of the steps are adjustably attached to the tread.

4 Claims, 6 Drawing Figures

STEPS OF PASSENGER CONVEYOR

BACKGROUND OF THE INVENTION

1. FIELD OF THE INVENTION

This invention relates to steps of passenger conveyors or escalators including moving stairways, moving pathways, etc.

2. DESCRIPTION OF THE PRIOR ART

Passenger conveyors generally referred to as escalators are nowadays indispensable to buildings for business use as service facilities. With the development of a network of subways in large cities and an increase in the number of stations disposed in high buildings, escalators have in recent years been built in an increasingly large number in subway stations and elevated stations, particularly in urban communities of high population density. The escalators installed in subway and elevated stations are under stringent conditions that have not been experienced by escalators before, and various problems have been raised in connection with installation and operation of escalators in an environment which is entirely different from that in which the predecessors have been installed and operated.

Up to the present, escalators have mostly been installed and operated in department stores and other facilities that cater to a large number of customers. As compared with the environment in which the escalators have hitherto been operated, the environment in which the escalators are now finding themselves poses new problems including the need to increase resistance to corrosion that might be caused by invasion of the escalator structure by underground water and the need to increase the surface strength of steps to avoid damage that might be caused by contact thereof with passengers. Thus, it has been desirable to develop steps of passenger conveyors that can cope with these problems arising from the new environmental conditions.

To meet this requirement, a proposal has been made in, for example, U.S. Pat. No. 2,033,308, to provide steps of an escalator by bending steel sheets. Each step is formed of stainless steel of 1–3 mm thick and worked by means of a press to form a plurality of cleats and grooves arranged alternately in parallel relation.

It has been found that this type of steps formed by means of a press raises a problem that should be solved to convey passengers safe and sound. More specifically, in forming about 100 cleats and grooves on a step of 100 mm in width, difficulties are experienced in absorbing cummulative errors and the clearance between the edges of the step and the skirt guard become irregular in size. When the clearance is smaller than is necessary, noise is produced by metal-to-metal contact between the steps and the skirt guard; when the clearance is larger than is necessary, the body of a passenger may accidently be drawn into the clearance.

SUMMARY OF THE INVENTION

This invention has been developed for the purpose of obviating the aforesaid problem of the prior art. Accordingly, the invention has as its object the provision of steps of a passenger conveyor of a novel construction enabling the steps to be produced with high dimensional accuracy.

The aforesaid object is accomplished according to the invention by forming each step from a steel sheet bent in such a manner that the step includes a cleat section in the center and planar surface portions at opposite side edge portions, each side edge portion having mounted thereon a side piece extending in the direction of movement of the steps.

DESCRIPTION OF THE PREFERRED EMBODIMENTS

Figure 1:
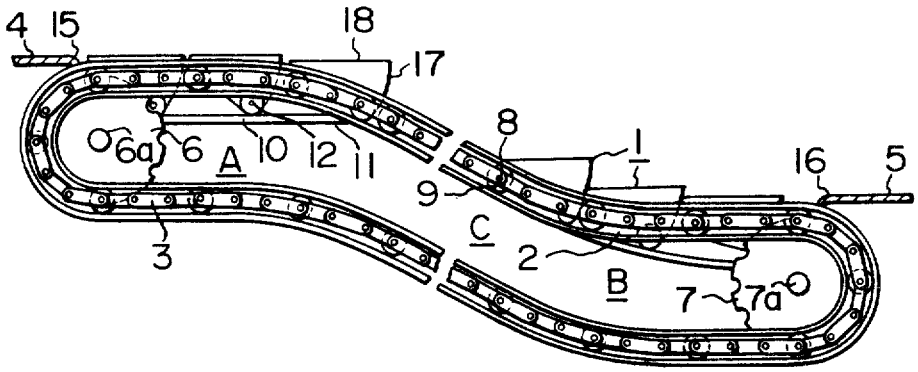
FIG.1 is a schematic side view of the whole of an escalator having incorporated therein steps comprising one embodiment of the invention.

The escalator comprises, as usual, a plurality of steps 1 linked in an endless belt for movement along rails 2 by the action of cahins 3 between an upper floor 4 and a lower floor 5. Each chain 3 is trained over a sprocket 6 on the upper floor 4 and by another sprocket 7 on the lower floor 5. The sprockets 6 and 7 on opposite sides of the steps 1 are supported by rotary shafts **6*a* and 7*a*, respectively, which, in turn, are supported by support means and driven by drive means as is known. The chains 3 support shafts 8 disposed equidistantly from one another for supporting the steps 1, and each shaft 8 supports rotary wheels 9 which roll along the rails 2**.

The rails 2 include an upper rail section A, a lower rail section B and an intermediate straight rail section C. The intermediate straight rail section C is inclined through 30 degrees with respect to the horizontal.

Each step 1 has a shaft 12 supporting a wheel 10 running along a rail 11, with the wheels 10 and 9 being spaced from each other a suitable distance in the direction of movement of the steps 1. Comb plates 15 and 16 are disposed on the upper floor 4 and the lower floor 5 respectively in positions in which the are aligned with cleats of the steps 1 presently to be described. Each step 1 has, of course, another shaft and another wheel at the other end, not shown.

Figure 3:
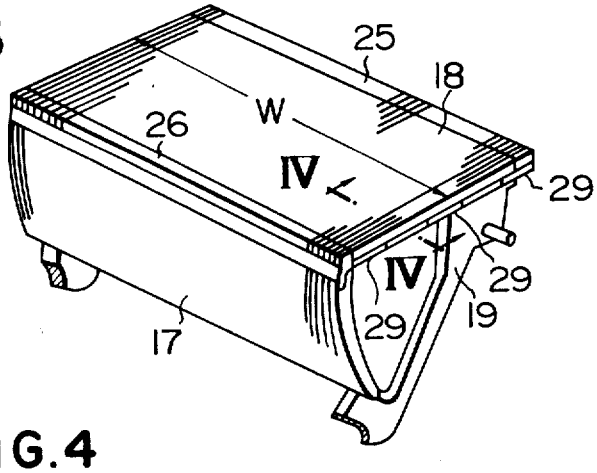
FIG. 3 is a perspective view, on an enlarged scale, of the step according to the invention.
Figure 4:
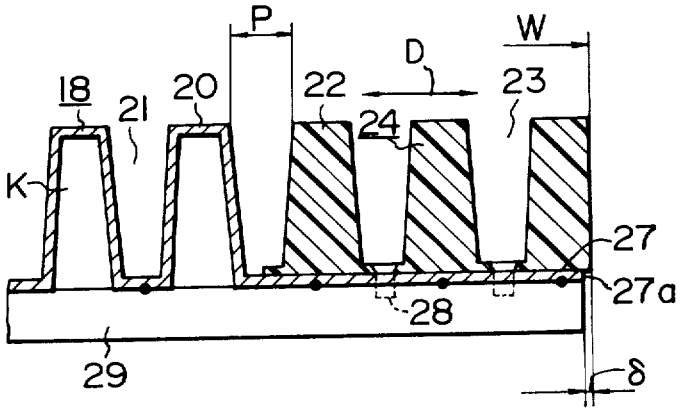
FIG. 4 is a cross sectional view taken along the line IV—IV in FIG. 3.
Figure 5:
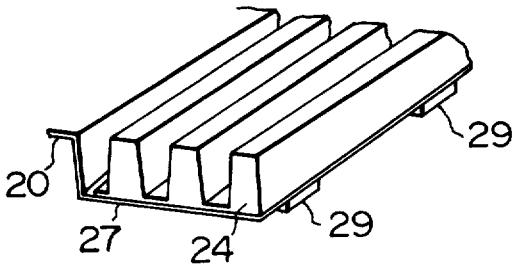
FIG. 5 is a fragmentary perspective view of the step showing the construction of its side edge position.

Referring to FIGS. 3 and 4, each step 1 includes a riser 17, a tread 18 having the riser 17 connected to one end thereof, and a plurality of frames 19 each attached to one of opposite sides edges of the tread 18 which is formed by means of a press with a multiplicity of cleats 20 and grooves 21 alternately located in the central portion and extending in the direction of movement of the step 1, and a plurality of planar surface portions 27 each disposed on one of opposite sides of the central portion. A side piece 24, made of a synthetic resinous material and formed with three cleats 22 and grooves 23, is attached to each of the planar surface portions 27, the side pieces 24 being usually colored yellow. The tread 18 of each step 1 includes comb-shaped fingers 25 and 26 attached to opposite ends thereof to close openings of the cleats 20 at opposite ends thereof. When necessary, the comb-shaped fingers 25 and 26 may be made of a synthetic resinous material and colored in the same color as the side pieces 24. The side pieces 24 are each rigidly screwed in place on one of the planar surface portions 27 at opposite edge portions of the step 1 having a width W, as indicated at 28. Reinforcing members 29 are attached to the undersurface of each step 1 and extend across its width from one frame 19 to the other frame 19, with the reinforcing members 29 being joined by spot welding to the undersurface of the tread 18 by utilizing the bottoms of the grooves 23. The reinforcing members 29 extend between the planar surface portions 27 of the step 1 having the side pieces secured to their undersurfaces. An outside edge 27*a* of each planar surface portion 27 is displaced inwardly by a distance δ of several millimeters from the outer edge W of the outermost cleat 22 of the side piece 24. The reinforcing members 29 are flush with the outside edges 27*a* of the planar surface portions 27 at opposite ends thereof. That is, the tread 18 and reinforcing members 29 each have a width smaller than W. Positioning of the side pieces 24 is effected as presently to be described.

Each side piece 24 is first positioned relative to an outer edge of the outermost cleat 20 of the central portion in such a manner that the step 1 has a width W by taking into consideration the tolerances with respect to the spacing interval P between the outermost cleat 20 and an innermost cleat 22 of the side piece 24. Then the side piece 24 is screwed in place at 28. At this time, the width W has reserve corresponding to the tolerances with respect to the spacing interval P, so that the side piece 24 can be moved within the tolerances in the directions of the double-headed arrow D shown in FIG. 4 before being correctly positioned.

Figure 2:
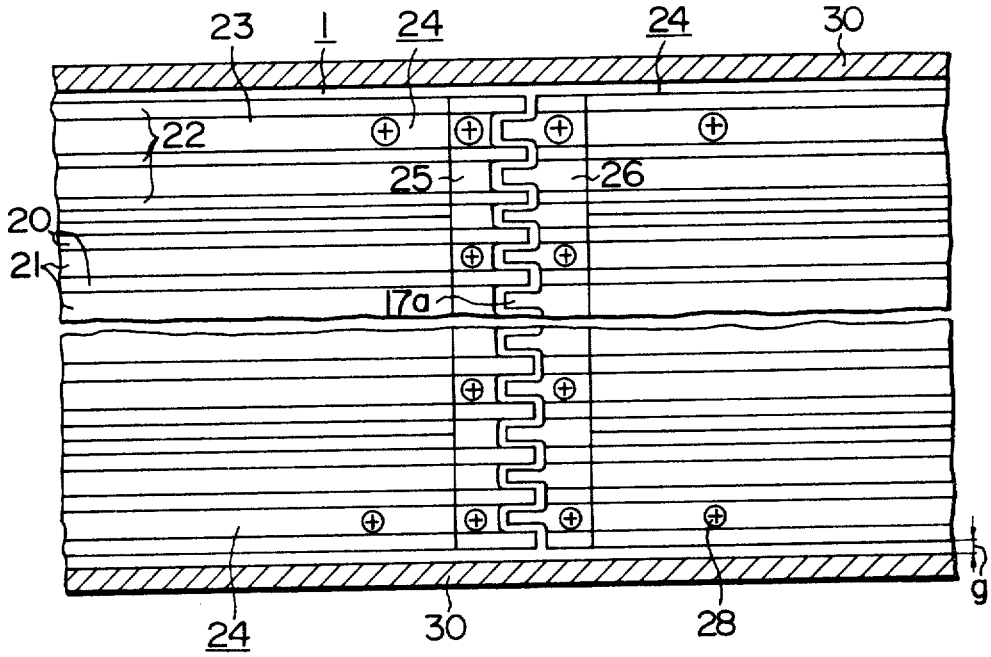
FIG. 2 is a plan view, on an enlarged scale, of the two steps and the skirt guard shown in FIG. 1.

In this fashion, cumulative errors made in the tread 18 of each step 1 when made by means of a press can be absorbed by transverse movement of the side pieces 24 across the width W thereof. As a result, the gap G (See FIG. 2) between each step 1 and a skirt guard 30 can be kept at a predetermined level at all times. The arrangement whereby the side pieces 24 are superposed over the planar surface portions 27 is conducive to increased strength of the planar surface portions 27. Thus, even if a passenger rides on the side pieces 24, the planar surface portions 27 would not be damaged. Even if the side pieces 24 are burned by a fire, the presence of the planar surface portions 27 prevents the step 1 from forming a gap on the tread 18. The provision of the reinforcing members 29 to the planar surface portions 27 having the side pieces secured thereto eliminates the risk of the occurrence of resonance.

Figure 6:
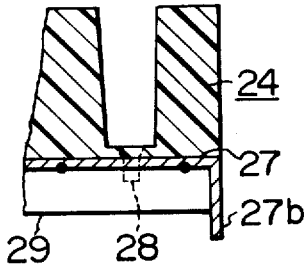
FIG. 6 is a fragmentary cross sectional view of the side edge portion of the step showing another embodiment of the invention.

In another embodiment of the invention shown in FIG. 6, each planar surface portion 27 of the tread 18 may be formed with a vertical member 27*b* extending downwardly from its outer edge. Also, the planar surface portions 27 need not be literally planar and any deviation from a perfectly planar surface may be tolerated so long as each side piece 24 can be secured thereto without any trouble, and the cleats 22 of each side piece 24 may be slightly larger in height than the cleats 20 in the central portion of the tread 18.

What is claimed is:

1. Steps of a passenger conveyor each comprising:

a tread formed with a multiplicity of cleats and grooves alternately disposed and extending in a direction of movement of the steps in alignment with teeth of comb plates mounted at embarkation and disembarkation areas of the passenger conveyor;

a riser connected to one end of said tread; and a plurality of frames each attached to one of opposite ends of said tread;

wherein the improvement comprises: reinforcing members interposed between said plurality of frames, said reinforcing members being joined by spot welding to an undersurface of said tread, said tread is formed of a steel sheet bent in such a manner so as to provide plannar steel sheet side edge surface portions with said cleats and grooves being located in a central portion of the tread between the plannar side edge surface portions said spot welding being effected by utilizing said grooves; and a plurality of side pieces disposed on said plannar side edge surface portions and extending in a direction of movement of the steps, said side pieces are transversely adjustably secured to said planar side edge surface portions by fastening means so as to enable a compensation of tolerance variations occuring during the bending of the steel sheet.

2. Steps of a passsenger conveyor as claimed in claim 1, wherein said plurality of side pieces are each formed of a synthetic resinous material and colored, and each said side piece is formed with a plurality of cleats and grooves.

3. Steps of a passenger conveyor as claimed in claim 1, wherein said planar side edge surface portions of said tread is formed at an outer edge of each said planar side edge surface portion with a vertical member extending downwardly therefrom.

4. Steps of a passenger conveyor as claimed in claim 1, wherein a plurality of comb-shaped fingers are each attached to one of said opposite ends of said tread to close open ends of said cleats.

* * * * *